United States Patent [19]

Colley et al.

[11] Patent Number: 5,054,463

[45] **Date of Patent: * Oct. 8, 1991**

[54] POWER SPRING BOW

[76] Inventors: David E. Colley, 1715 Ozora Rd., Loganville, Ga. 30249; Donald G. Fain, 365 Jordan Dr., Tucker, Ga. 30084; Frederick R. Arnett, 1609 Carter Rd., Decatur, Ga. 30032

[ * ] Notice: The portion of the term of this patent subsequent to Feb. 27, 2007 has been disclaimed.

[21] Appl. No.: 458,415

[22] Filed: Dec. 28, 1989

Related U.S. Application Data

[63] Continuation-in-part of Ser. No. 266,066, Nov. 2, 1988, Pat. No. 4,903,677.

[51] Int. Cl.[5] ..... F41B 5/00

[52] U.S. Cl. ..... 124/25.6; 124/900

[58] Field of Search ..... 124/23 R, 24 R, 25, 124/DIG. 1, 23.1, 24.1, 25.6, 900

[56] References Cited

U.S. PATENT DOCUMENTS

| | | | |
|---|---|---|---|
| 4,060,066 | 11/1977 | Kudlacek | 124/23 R |
| 4,291,452 | 9/1981 | Whitman et al. | 124/23 R X |
| 4,457,288 | 7/1984 | Ricord | 124/23 R |
| 4,512,326 | 4/1985 | Jarrett | 124/23 R |
| 4,593,674 | 6/1986 | Kudlacek | 124/23 R |
| 4,757,799 | 7/1988 | Bozek | 124/23 R |
| 4,858,588 | 8/1989 | Bozek | 124/23 R |
| 4,903,677 | 2/1990 | Colley et al. | 124/23 R |

OTHER PUBLICATIONS

PSE brochure, author, date unknown.

Bow Report, Norb Mullaney, pp. 63–68, date unknown.

*Primary Examiner*—Peter M. Cuomo

*Assistant Examiner*—John A. Ricci

*Attorney, Agent, or Firm*—Kimmel, Crowell & Weaver

[57] ABSTRACT

An archery bow design in which a pair of flexible limbs are secured on opposite ends of a riser that defines a hand grip or handle, and wherein recoil assemblies at opposite ends of the riser are connected with a bow string to bias the string in a first direction for propelling an arrow. In one form of the invention, a recoil cable extends from the free end of each limb to a cam at the opposite end of the riser, and the cam is connected for rotation with a take-up spool for storing cable. The bow string is connected with the take-up spool, whereby the take-up spool is rotated when the bow string is drawn, thereby rotating the cam and deflecting the limb to store energy for propelling an arrow. In another form of the invention, the recoil cables are omitted and flat wound coil springs are connected with the cam so that when the bow string is drawn the flat wound coil springs store energy. The cam provides a let-off feature whereby a relatively small force is required to draw the bow and hold it in a fully drawn position, and a relatively higher recoil velocity is obtained when the string is released.

15 Claims, 11 Drawing Sheets

POWER SPRING BOW

This application is a continuation-in-part of applicant's prior copending application Ser. No. 266,066, filed Nov. 2, 1988, now U.S. Pat. No. 4,903,677.

FIELD OF THE INVENTION

This invention relates in general to the art of archery, and more particularly, to archery bows.

DESCRIPTION OF THE PRIOR ART

The art of archery is nearly as old as the use of tools by man. In its present state, archery is used primarily in recreational target shooting, competitive target shooting, and hunting.

Early archery bows consisted essentially of an elongate piece of wood having a central hand grip portion with resilient, spring-like limbs projecting from opposite ends thereof and a bow string stretched tightly between the outer ends of the limbs. This basic structure has been modified to include recurve or reverse curve bows, and compound bows utilizing a series of levers and cams to multiply the propelling force and/or provide a let-off of the force required to draw and hold the bow in a fully drawn position preparatory to release of an arrow. Other prior art efforts to improve the accuracy and range of archery equipment have included crossbows, which incorporate a rifle-like stock having spring arms at a forward end and a trigger mechanism for holding and releasing the bow string.

Included among those features most desirable in an archery bow are: compact design; light weight; high release energy with small draw force, i.e., let-off bows; accuracy; silence and efficiency in operation; range; and craftsmanship., simplicity and economy in construction.

Examples of some prior art archery bows and related devices are described in the following U.S. Pat. Nos. 3,515,113, 3,874,359, 3,989,026, 3,993,039, 4,018,205, 4,183,345, 4,227,509, 4,287,867, 4,338,909, 4,388,914, 4,457,288, 4,458,657, 4,646,708, 4,651,707, 4,688,539, 4,722,317, 4,724,820 and 965,361. Some of these patents describe crossbows and others describe sling shots. The remaining patents disclose various constructions of more or less conventional bow technology, i.e., bows utilizing spring-like limbs projecting from opposite ends of a central hand grip portion, and including compound bows or bows with levers, cables and springs intended to increase the force or energy of the bow and/or reduce the amount of force required to draw the bow, i.e., let-off. Some of these bows are substantially complex and expensive in construction, while others are relatively heavy and cumbersome to carry and operate. Still others would have low reliability because of the complexity of construction and use of relatively fragile multiple strings, etc.

In applicant's copending application Ser. No. 266,066, an improved archery bow is disclosed in which rigid limbs project from opposite ends of a riser or handle, and a flat wound coil spring is used to store energy for propelling an arrow. This bow is exceptionally short in length, and overcomes many of the problems of prior art bows discussed above, while at the same time possessing the power and accuracy of conventional bow designs.

It would be desirable to have a bow which is compact and lightweight in design and construction, and which has the accuracy and power of conventional bows, preferably with a let-off feature which reduces the force required to hold the bow at full draw, and which requires fewer parts than prior art bows.

SUMMARY OF THE INVENTION

Accordingly, it is an object of the present invention to provide an archery bow which is compact and lightweight in design.

Another object is to provide an archery bow which has a high recoil energy or thrust and which is designed to provide a reduction in the force required to draw and hold the bow at full draw.

A further object of the invention is to provide an archery bow which is distinct in appearance and operation.

A still further object of the invention is to provide a archery bow in which a flat wound power spring is used in combination with flexible limbs as the energy storing medium, enabling the remaining components of the bow to be of lightweight construction.

Yet another object of the invention is to provide an archery bow employing multiple mechanical advantages in conjunction with a unique spring design, enabling a wide range of performance characteristics to be obtained.

Another object of the invention is to provide an archery bow of compact and lightweight design, in which pulleys and cam means function with flexible limbs to achieve a desired power.

The foregoing and other objects and advantages of the invention are achieved according to one form of the invention by a novel bow design in which a pair of relatively short, powerful, flexible limbs are carried at opposite ends of a handle and a combination of pulley and cam means is connected with the limbs to achieve a desired power with minimum effort to draw and hold the bow in fully drawn position.

In accordance with another form of the invention, at least one flat wound power spring is connected to operate in conjunction with the flexible limbs to achieve the desired characteristics. In this latter form of the invention, the coil spring is mounted on a riser or handle and is connected through an eccentric wheel or cam and a pulley system to a bow string so that the action of drawing back the bow string causes the coil spring to be wound up, and the limbs to flex, storing energy. The eccentric wheel or cam and the pulley system provide a mechanical advantage whereby a relatively small force is required to draw the bow and wind up the power spring, and a relatively higher recoil velocity is obtained when the string is released.

BRIEF DESCRIPTION OF THE DRAWINGS

The objects and advantages set forth above, as well as other objects and advantages of the invention, will become apparent from the following detailed description and claims when considered in conjunction with the accompanying drawings, wherein like reference characters designate like parts throughout the several views, and wherein:

DETAILED DESCRIPTION OF THE PREFERRED EMBODIMENTS

Figure 1:
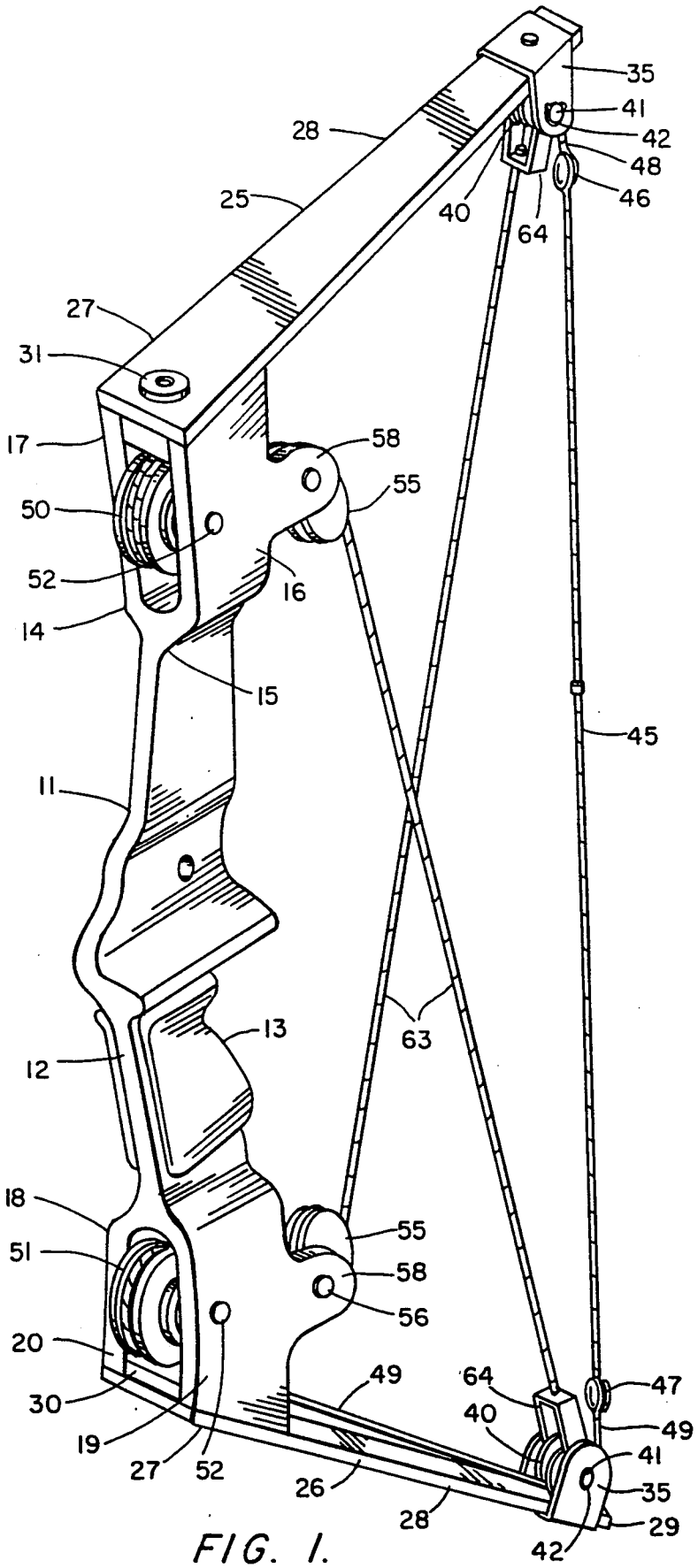
FIG. 1 is a front perspective view of a preferred bow in accordance with the invention, showing the bow in an at-rest condition.
Figure 2:
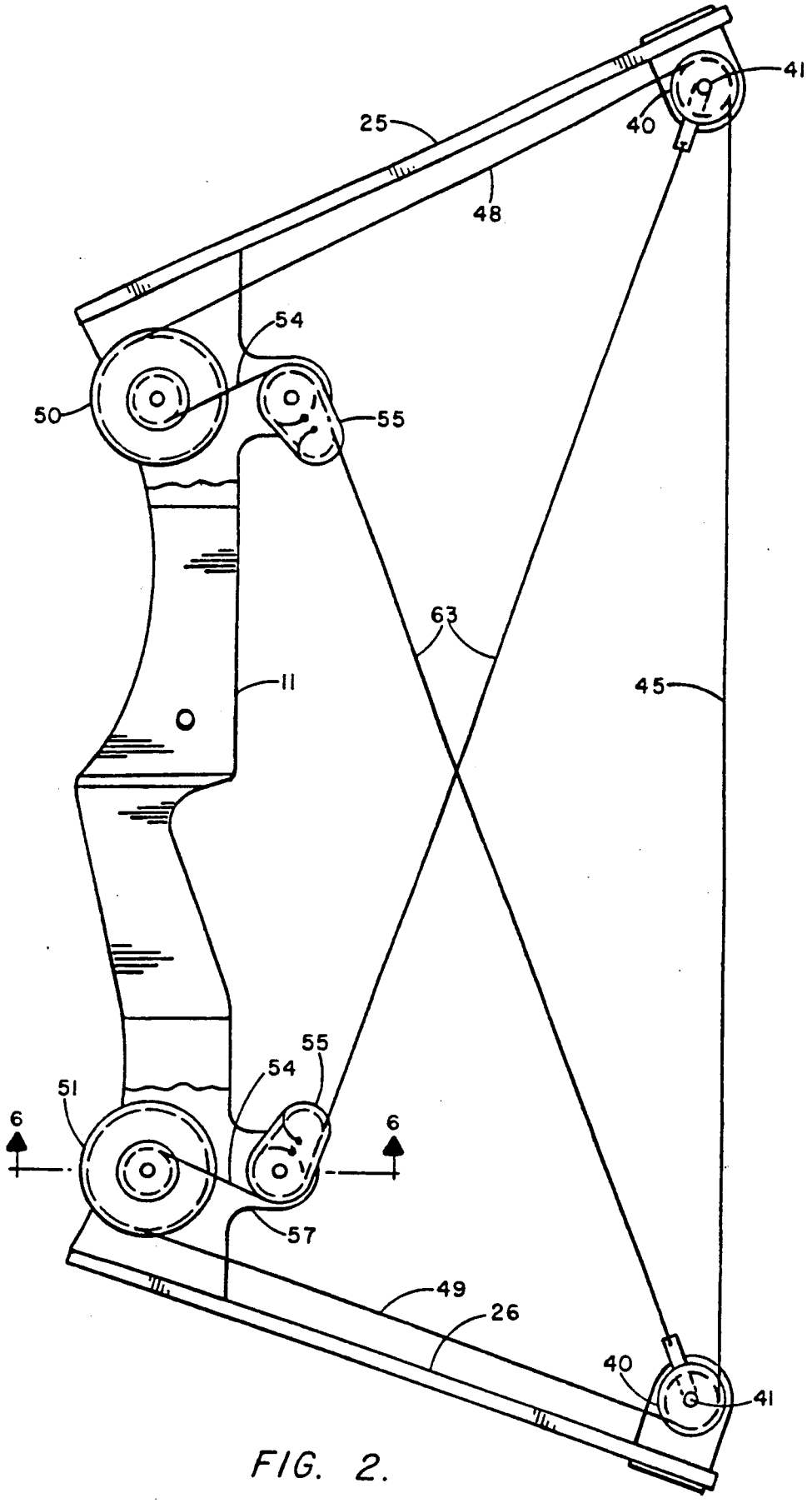
FIG. 2 is a right side view in elevation of the bow of FIG. 1, with portions cut away or removed for purpose of clarity, showing the bow in an at-rest condition.
Figure 3:
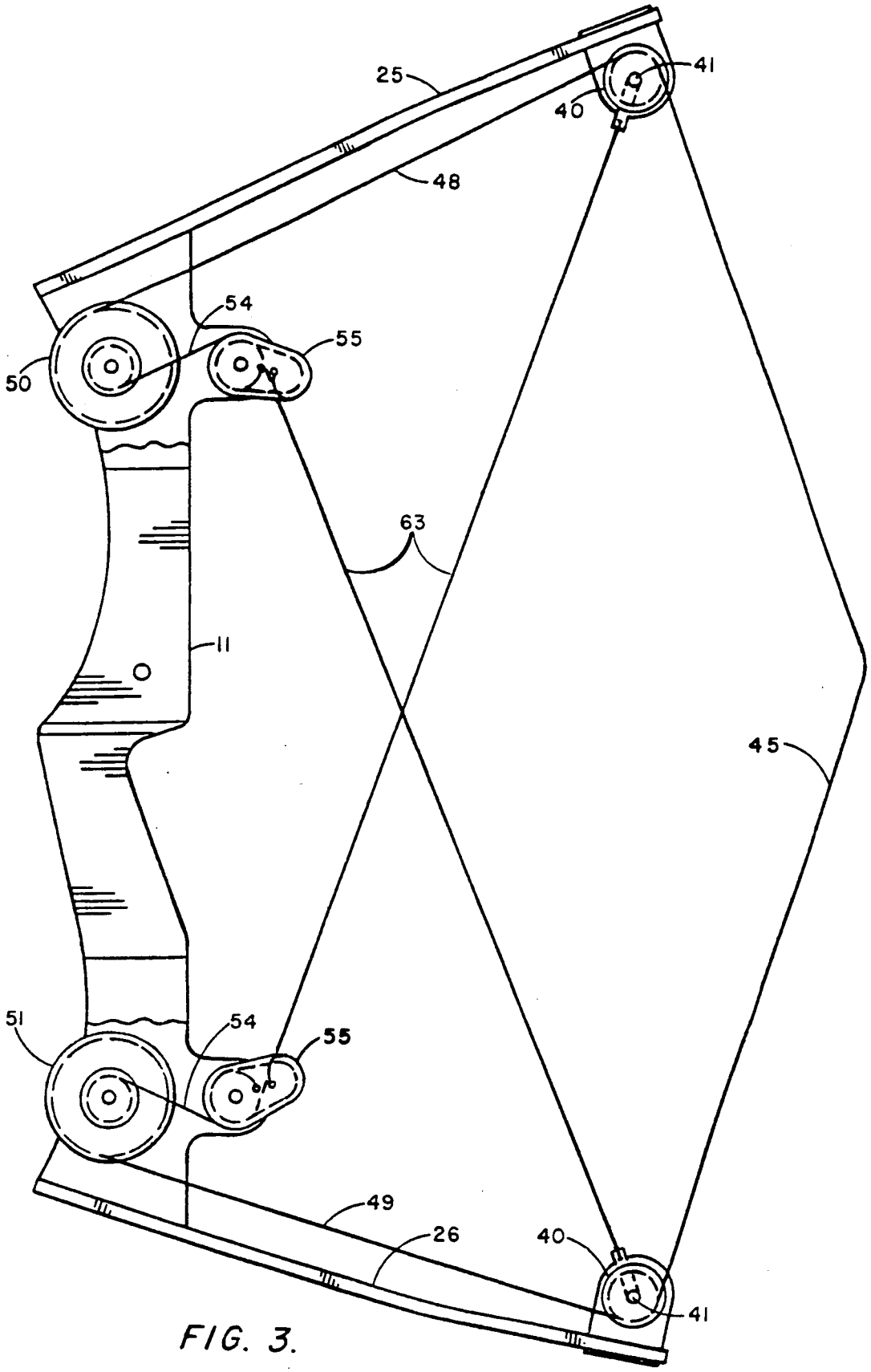
FIG. 3 is a right side view in elevation of the bow of FIG. 1, with portions removed for purpose of clarity, showing the bow at approximately one fourth draw.
Figure 4:
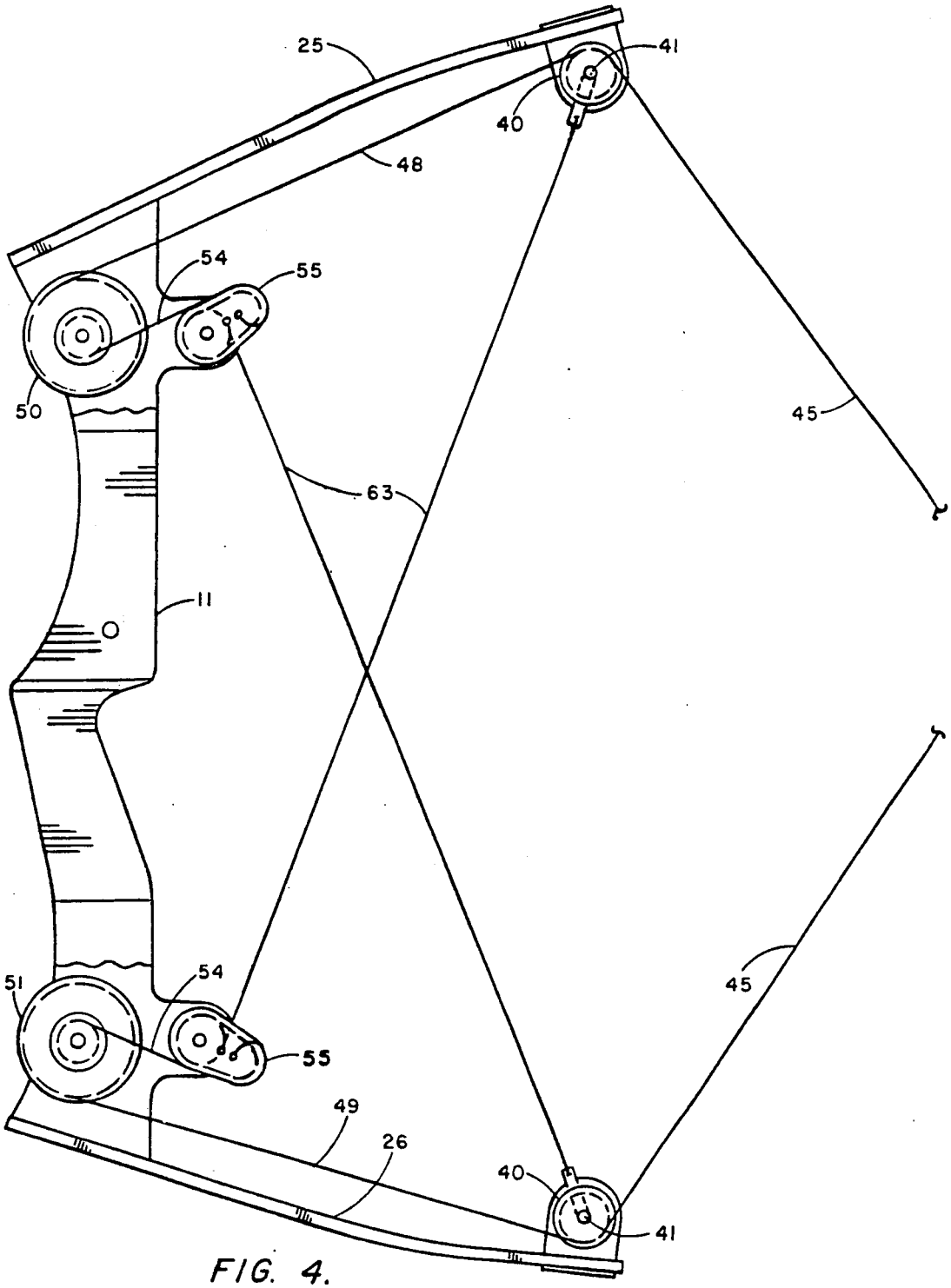
FIG. 4 is a right side view of the bow of FIG. 1, with portions removed for purpose of clarity, showing the bow at approximately one half draw.
Figure 5:
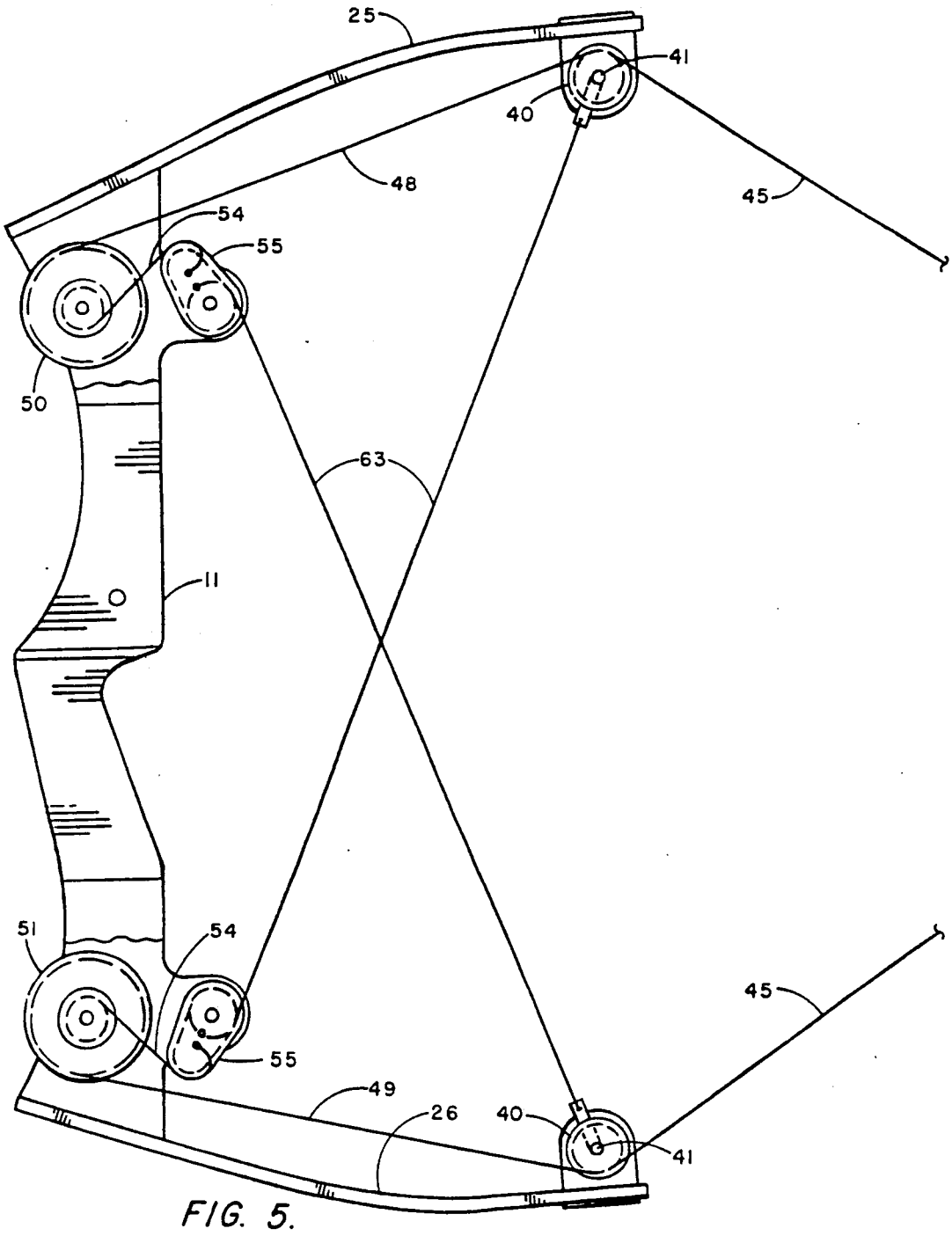
FIG. 5 is a right side view of the bow of FIG. 1, with portions removed for purpose of clarity, showing the bow in a fully drawn position.
Figure 6:
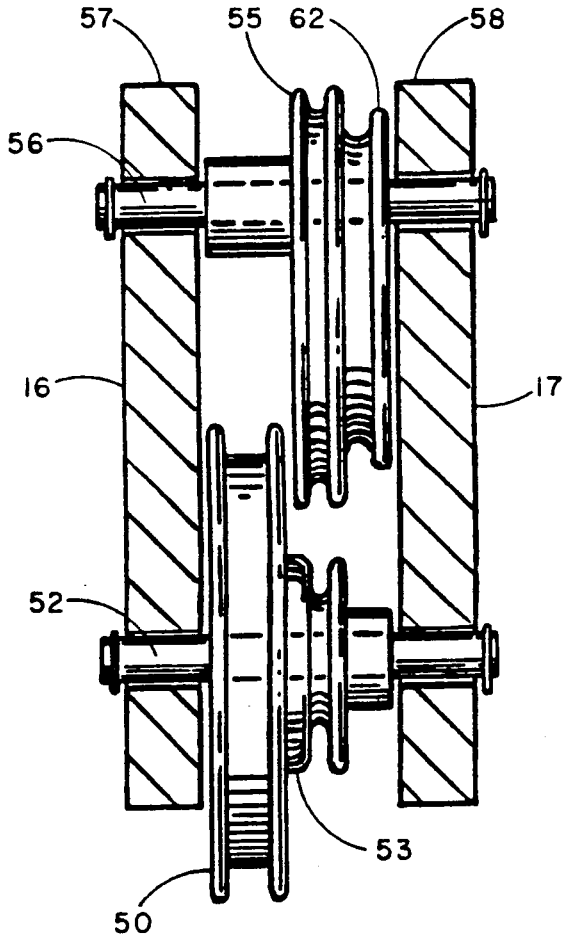
FIG. 6 is a greatly enlarged, fragmentary sectional view taken along line 6—6 in FIG. 2.

Referring more particularly to the drawings, a first form of archery bow in accordance with the invention is indicated generally at 10 in FIGS. 1–6. The bow comprises a riser or handle 11 having a generally centrally disposed hand grip portion 12, to which a contoured grip or pad or the like 13 may be applied. The riser includes a first, upper end portion 14 terminating in its outer end in a thickened section 15 which is bifurcated to define two spaced apart mounting arms 16 and 17. A second, lower end portion 18 extends from the other end of the hand grip portion, and is much shorter than the upper arm portion 14. Moreover, the lower end portion is shaped substantially identically to the thickened and bifurcated end 15 on the other end of the riser, and includes a pair of spaced apart mounting arms 19 and 20.

Figure 7:
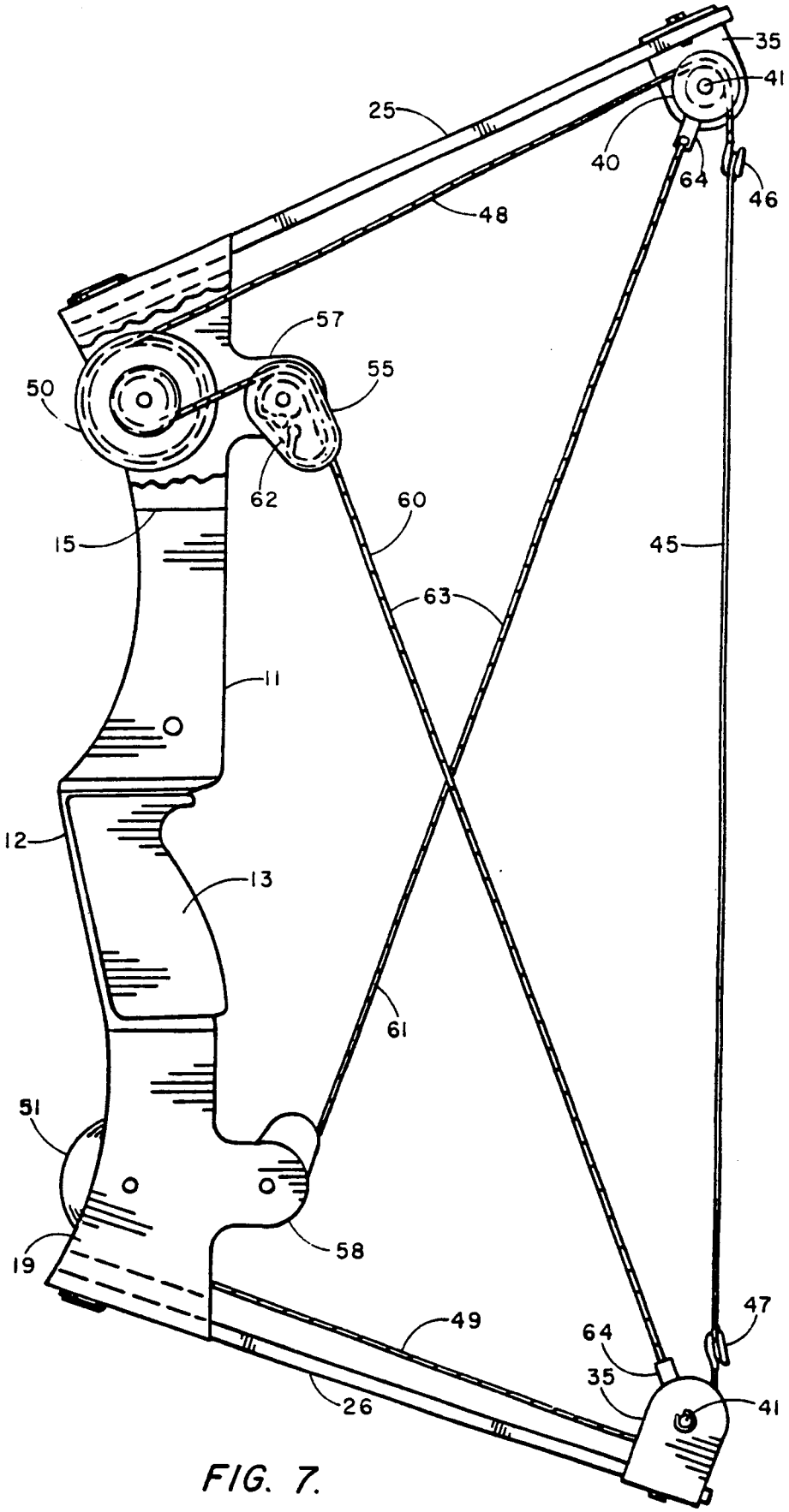
FIG. 7 is a right side view in elevation, with portions broken away, of the bow of FIG. 1.
Figure 8:
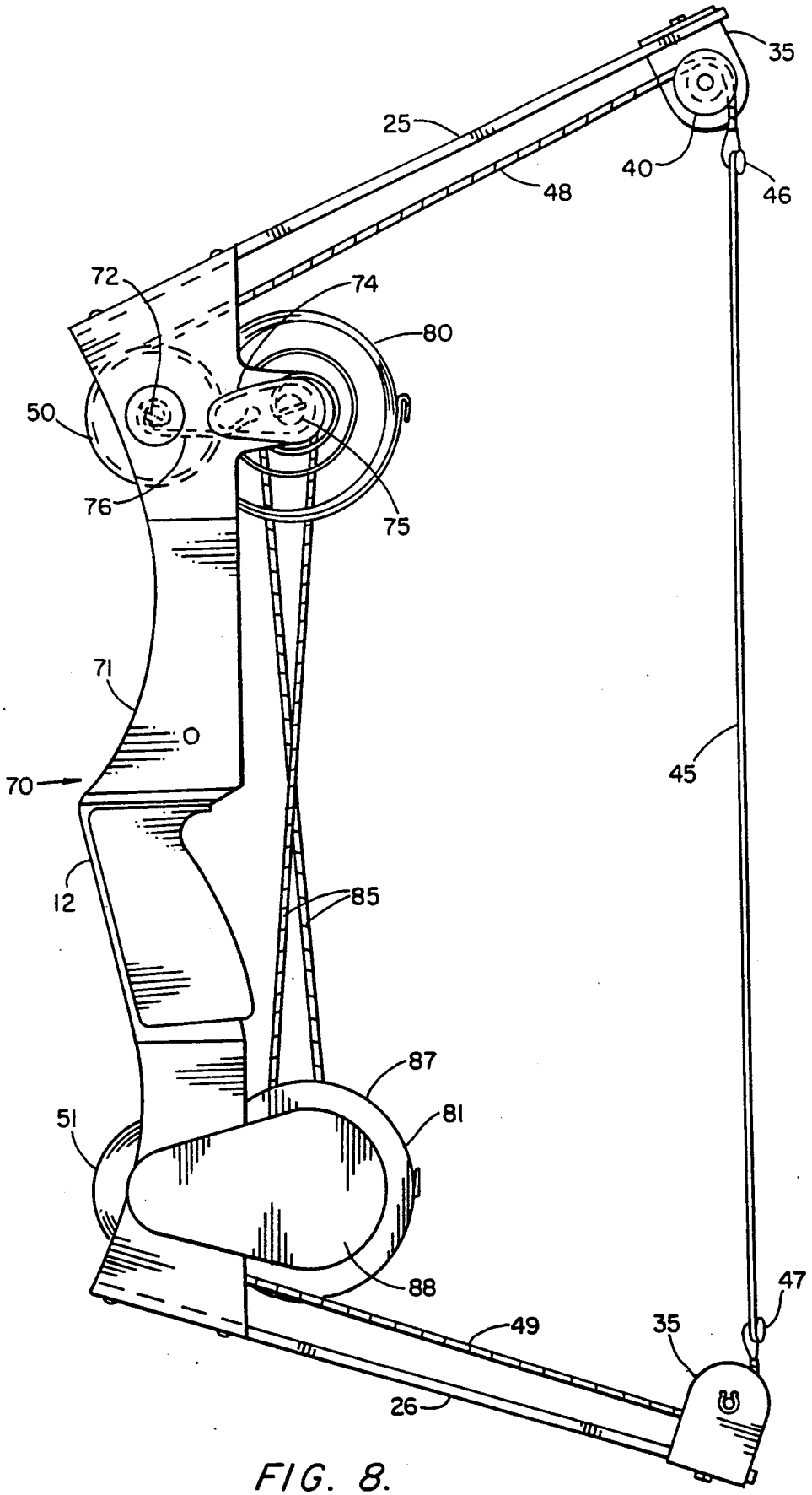
FIG. 8 is a view in side elevation, with portions removed for purpose of clarity, of a modified bow in accordance with the invention, wherein a flat wound coil spring is used in conjunction with the flexible limbs.
Figure 9:
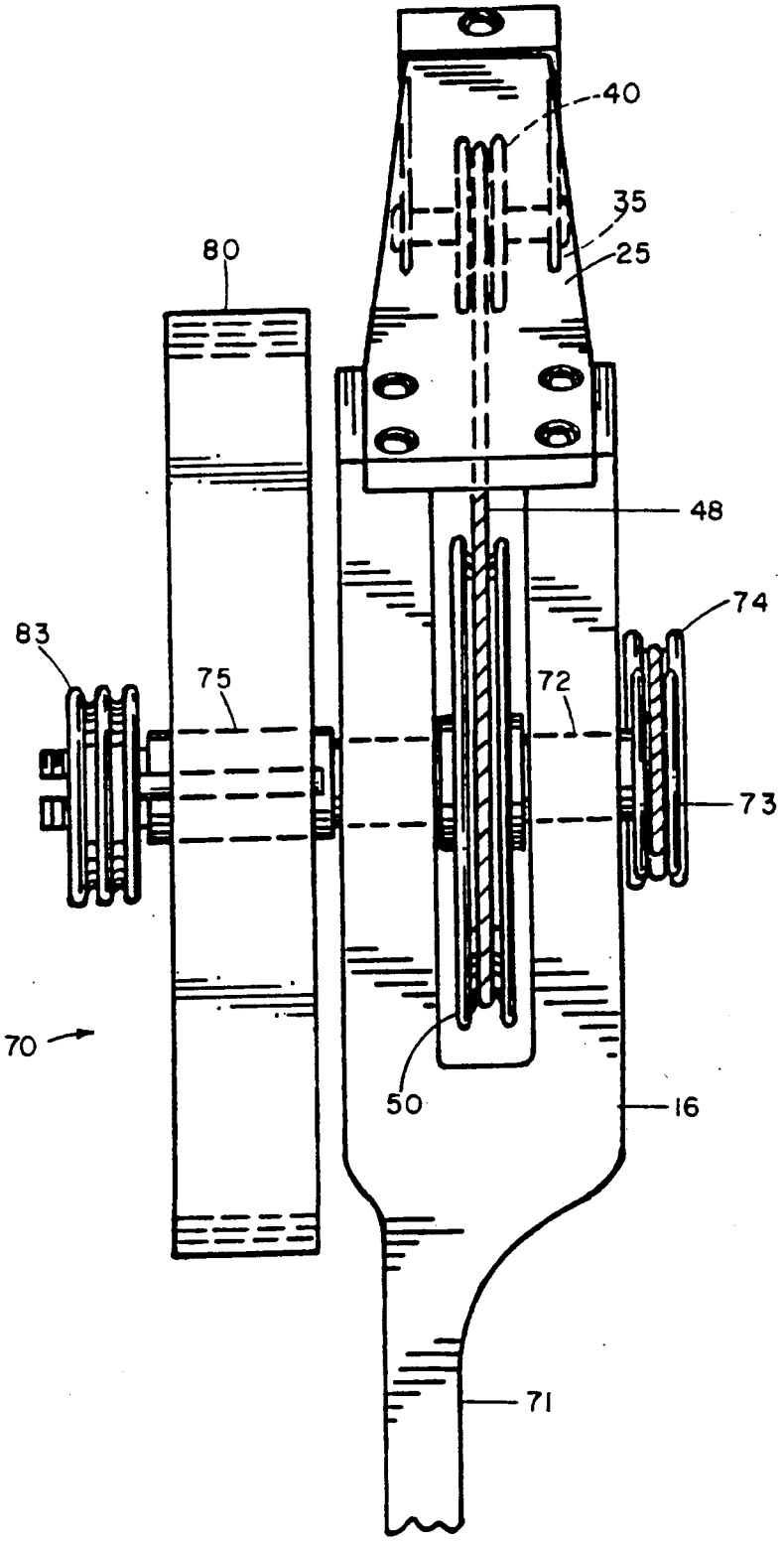
FIG. 9 is an enlarged fragmentary view in front elevation, showing a portion of the bow of FIG. 8.

A pair of flat cantilever springs defining flexible arms or limbs 25 and 26 of substantially identical construction are secured on the opposite ends of the riser 11. As seen in FIGS. 1 and 7, each limb is essentially flat, with a rectangular base end 27 and an elongate tapered body 28 terminating in a rectangular tip 29. A rectangular mounting block 30 is secured by suitable fasteners 31 to the rectangular base end 27 of each limb, and the mounting blocks of the respective limbs are secured between the mounting arms at opposite ends of the riser, thereby securing the limbs to the riser. As seen best in FIG. 1, the base ends of the limbs are slightly wider than the mounting blocks, whereby the limbs overlie the ends of the riser when the arms are mounted thereto.

A U-shaped idler wheel bracket 35 is secured to the tip end of each limb, and an idler wheel or pulley 40 is supported between opposite sides of the bracket by a pin 41. The pin and pulley may be retained in place by spring clips 42 or other suitable means, as desired.

A bow string means extends between the free ends of the limbs and is connected with recoil assemblies on the riser. The bow string means includes a bow string 45 attached via suitable connections 46 and 47 at its opposite ends with the respective ends of a pair of drive cables 48 and 49 at opposite ends of the bow. The drive cables extend over the respective idler wheels 40 and thence inwardly alongside each limb to respective cable take-up spools 50 and 51 supported on an axle 52 extending between the bifurcated end portions of the riser. The drive cables are attached to the cable spools and are wrapped around the spools one or more times to store the necessary amount of cable to achieve a desired draw for the bow. A cam drive wheel 53 is also attached to each of the axles 52, and rotates with the respective cable spool.

The cam drive wheels, in turn, are each connected via a short length of cable 54 with an eccentric cam 55 carried on a second rotatable axle 56 extending between projecting arms 57 and 58 on the bifurcated ends of the riser.

Recoil assemblies 60 and 61 are connected between the ends of the riser and the outer free end of the opposing limb to produce deflection of the limbs and thus store energy when the bow string is drawn rearwardly. Each recoil assembly comprises a recoil spool 62 supported adjacent the cam on the axle 56 for rotation therewith, and a recoil cable 63 connected at one end with the respective recoil spools and extending at its other end to connection with a floating cable bracket 64 mounted on the pin 41 carried by the bracket 35 at the outer end of each limb.

When the bow string is pulled rearwardly, or to the right as viewed in FIGS. 1–5, the cables 48 and 49 are pulled outwardly over the idler wheels 40, unwinding from the respective cable spools 50 and 51, causing the shafts 52 and thus the cam drive wheels 53 to rotate. This, in turn, causes the cams 55 to rotate via the connection of cam drive cable 54, which causes recoil spools 62 to rotate and take up recoil cable 63, pulling the ends of limbs 25 and 26 inwardly and storing energy. When the bow string is released, the stored energy in the deflected limbs is released, imparting a pulling force on the recoil cables which, through the recoil spool and cam, cause the respective cable spools to rotate in the opposite direction to that caused when the bow string was pulled rearwardly. This again winds up the drive cables 48 and 49 on the cable spools, and restores the bow string to its original position, propelling the arrow forwardly.

The cam is configured such that, as it is driven by the transfer of cable from the cam to the cam drive wheel, the point at which cable leaves the cam changes so as to be positioned a different distance away from the axis of rotation, thus creating a changing lever arm that causes a reduction in the force required to draw and hold the bow string.

The amount of energy stored in each limb is governed by the specifications of the limb, including limb dimensions and material. Further, in designing the limbs, consideration must be given to the length of recoil cable which is wound up onto the recoil spool. A recoil spool of a given diameter would take up more, or less, cable than a spool of a greater, or smaller, diameter. However, the limbs must be designed so that the amount of deflection caused by the take up of recoil cable causes the desired amount of energy to be stored.

The amount of draw force required to operate the bow may be adjusted in any of a number of different ways. One such way is to increase the diameter of the recoil spool by either replacing the spool with one of larger diameter, or by installing an insert around the existing spool. By increasing the diameter of the recoil spool, the amount of cable which is wound onto the spool during its one operating revolution is increased, thus causing an increase in deflection of the opposing limb and thereby storing additional energy. Another way to alter the amount of draw force required to operate the bow is by the use of a limb tensioning device located at each end of the riser. This may comprise a threaded bolt engaged between a stop on the riser and an inner or rearward portion of the limb, with the limb being pivotally connected to the riser at a forward or outer portion of the limb. Thus, manipulation of the tensioning device causes the limb to pivot about its forward edge, tending to urge the free ends of the opposing limbs toward or away from one another, depending upon the direction of rotation of the tensioning device, and thereby imparting greater or less pre-tension on the limbs. The same thing may be accomplished by use of a sliding wedge located between the riser and limb; or by use of a cable tensioning device located on either the recoil spool or on the bow string; or by installing a shorter bow string; etc.

Since the limbs of the bow are the sole means of energy storage in this form of the invention, the design of the limbs, with respect to length, width, thickness, taper and material determines the total energy available, which may be altered by varying the required limb specifications.

The limbs must be designed such that the amount of torque developed per degree of deflection functions in cooperation with the volume of cable wound onto the recoil spool to achieve the desired poundage at full draw. In other words, as the diameter of the recoil spool is increased, a greater length of cable will be taken up during the operating cycle, thus flexing the limb to a greater extent. If the desired poundage at full draw (not allowing for let-off achieved by the cam) is to be 50 pounds, for example, and the recoil cable is wound up onto the recoil spool so as to deflect the limb one-half inch, then the limb must be designed to develop 50 pounds of torque at one-half inch of deflection. Flat cantilever springs develop torque in a linear manner. Therefore, a base or design torque must be established, and a range of available adjustment in torque calculated based on the amount of adjustment available (additional or decreased deflection of the limb) within the limits of the particular adjustment means. Using standard, generally accepted formulae for calculating the load capacity of cantilever springs, and applying the properties of various materials, a limb design may be obtained which provides a desirable range of poundage adjustments.

Because each recoil assembly is driven by a limb located on the opposing end of the riser, and because limbs may be manufactured with a greater degree of uniformity than that of coil springs, it is believed that it will not be necessary to use a synchronizing mechanism such as that used on the bow described in applicant's copending application. If, however, it is found that an adequate balance is not achieved in the design described above, a similar synchronizing mechanism may be employed. Another means of balancing the two recoil assemblies may be through the addition of a second recoil cable connected to each recoil spool at one end of the riser, and to the adjacent limb at the opposing end of the riser, thereby causing both limbs to be deflected simultaneously by the recoil spools. This particular means of synchronization would require that the limb design be altered slightly to accommodate the effect of an additional point of pull.

Further, although it is believed that the bow in this form of the invention will be adequately balanced by the recoil assemblies acting against opposing limbs, additional balancing may be achieved by re-routing the recoil cables through additional idler wheels located at some point along the limb between the riser and the idler wheels at the free end of the limb.

A modification of the invention is represented generally at 70 in FIGS. 7–10. This form of the invention is similar to that previously described and illustrated, in that it uses a bow string means extending between the free ends of opposing spring limbs and connected to recoil assemblies on the riser. More specifically, the bow string 45 is attached through connections 46 and 47 with a pair of drive cables 48 and 49 that are entrained over idler wheels 40 at the free ends of spring limbs 25 and 26 attached to the opposite, bifurcated ends of a riser 71. The drive cables are attached to and wound upon cable spools 50' and 51' rotatably supported between the arms 16' and 17' of the bifurcated ends of the riser on an axle 72.

A cam drive wheel 73 is also carried by the axle 72, but unlike the previously described form of the invention, is located outside of the bifurcated end of the riser. An eccentric cam 74 is carried on an axle or shaft 75 extending between projections 57', 58' on the bifurcated end, and is disposed in the same plane as the cam drive wheel. A cam cable 76 is connected between the cam drive wheel and the cam to cause them to rotate together.

In contrast to that form of the invention previously described, this form of the invention uses a pair of flat wound coil springs 80 and 81 mounted on opposite ends of the riser, on the opposite side thereof from the cam and cam drive wheel, and connected on the same shaft or axle 75 that carries the cam and cam drive wheel, with synchronizing wheels 83 and 84 carried on the respective shafts outboard of the coil springs. A synchronizing cable 85 is looped in a figure eight configuration on the synchronizing wheels at opposite ends of the riser, and through the system of wheels and cables synchronizes the motion between the assemblies at the opposite ends of the risers.

The synchronizing wheels, flat wound coil springs and cam and cam drive wheels may all be enclosed in suitable housings 86, 87 and 88, respectively, if desired.

It should be noted that the flat wound coil springs have one of their ends connected for rotation with a respective cam, while their other end is fixed against movement on the housing enclosing the spring. Thus, as the cam is caused to rotate upon drawing the bow string as previously described, the flat wound coil springs are wound up more tightly, storing energy. At the same time, the limbs will be caused to flex inwardly because of the inward component of force imposed thereon by the drive cables entrained over the idler wheels. This stored energy is released when the bow string is released, returning the various wheels and cables to their original positions, and propelling an arrow.

In operation, the spring assemblies are initially set up with a pre-tension. When the bow string is drawn back, it pulls the cables 48 and 49 and rotates the cable spools 50' and 51', which in turn rotate the cam drive wheels 73. The cam cable 75 thus causes the cams 74 to rotate, imparting rotation to the shaft 75 and winding up the respective springs 80 and 81. The synchronizing cable 85 transmits the same motion to opposite ends of the bow, ensuring balanced operation. This action stores energy in the springs 80 and 81, which, when the bow string is released, quickly retracts the cables 48 and 49 and pulls the bow string forward to propel an arrow nocked therein.

The relationships of the diameters of the various drive wheels and spools, and the shape and eccentricity of the cam, all give rise to multiple mechanical advantages while the bow string is being drawn, requiring less force to draw back the bow string for a given power rating of the bow. Conversely, upon release of the bow string, the same mechanical advantages result in increased velocity of the movement of the bow string and thus an arrow propelled thereby.

The flat wound coil springs, diameters of the various wheels and pulleys, eccentricity of the cam, and shape, size and material of the limbs may all be selected to give a desired characteristic to the bow. In this regard, power springs or flat wound coil springs are of rectangular section material and are secured at their opposite ends. As the length to thickness ratio increases, the spiral space between coils increases rapidly. Other than the transition coils and the coil which is attached to the shaft 75, the remaining coils are solidly against the housing. As the shaft rotates, solid material will become active as it pulls away from the housing and is wound upon the shaft. The amount of active material is constantly changing, producing a non-linear force curve. Thus, by varying the specifications of the spring, the force characteristics of the spring can be varied.

In either form of the invention described herein, the cam may be given any one of various configurations in order to achieve various let-off and peak weight duration characteristics. Design parameters are similar to those encountered in designing conventional compound bows. For instance, an eccentric which takes the form of a round wheel with an offset axle produces a smooth let-off but does not allow for a long duration of realized peak weight. An eccentric which takes the form of a cam produces a more enhanced peak weight duration, but lets-off in a dramatic manner, thus creating a more erratic draw.

Figure 10:
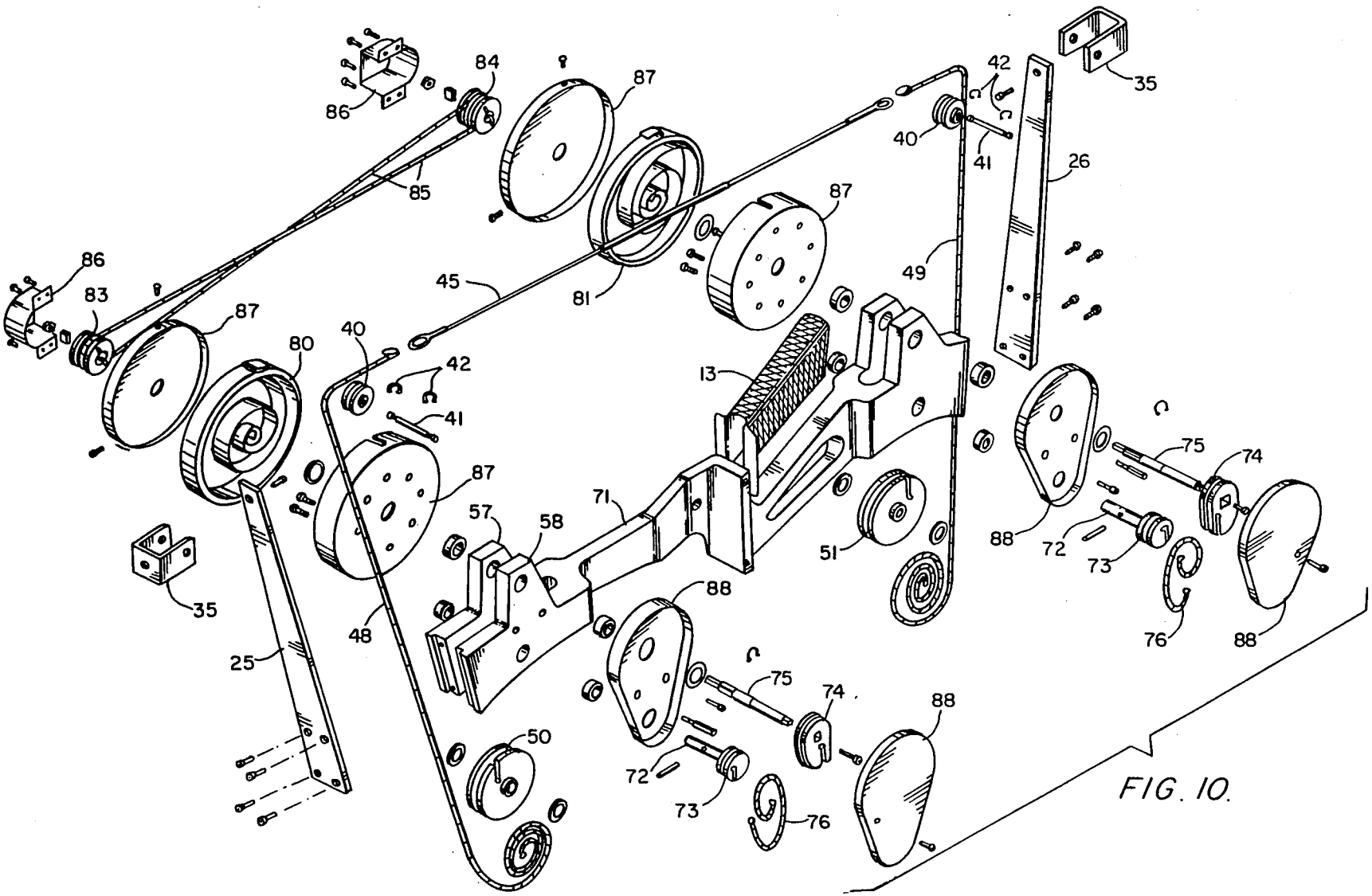
FIG. 10 is an exploded perspective view of the bow of FIG. 8.
Figure 11:
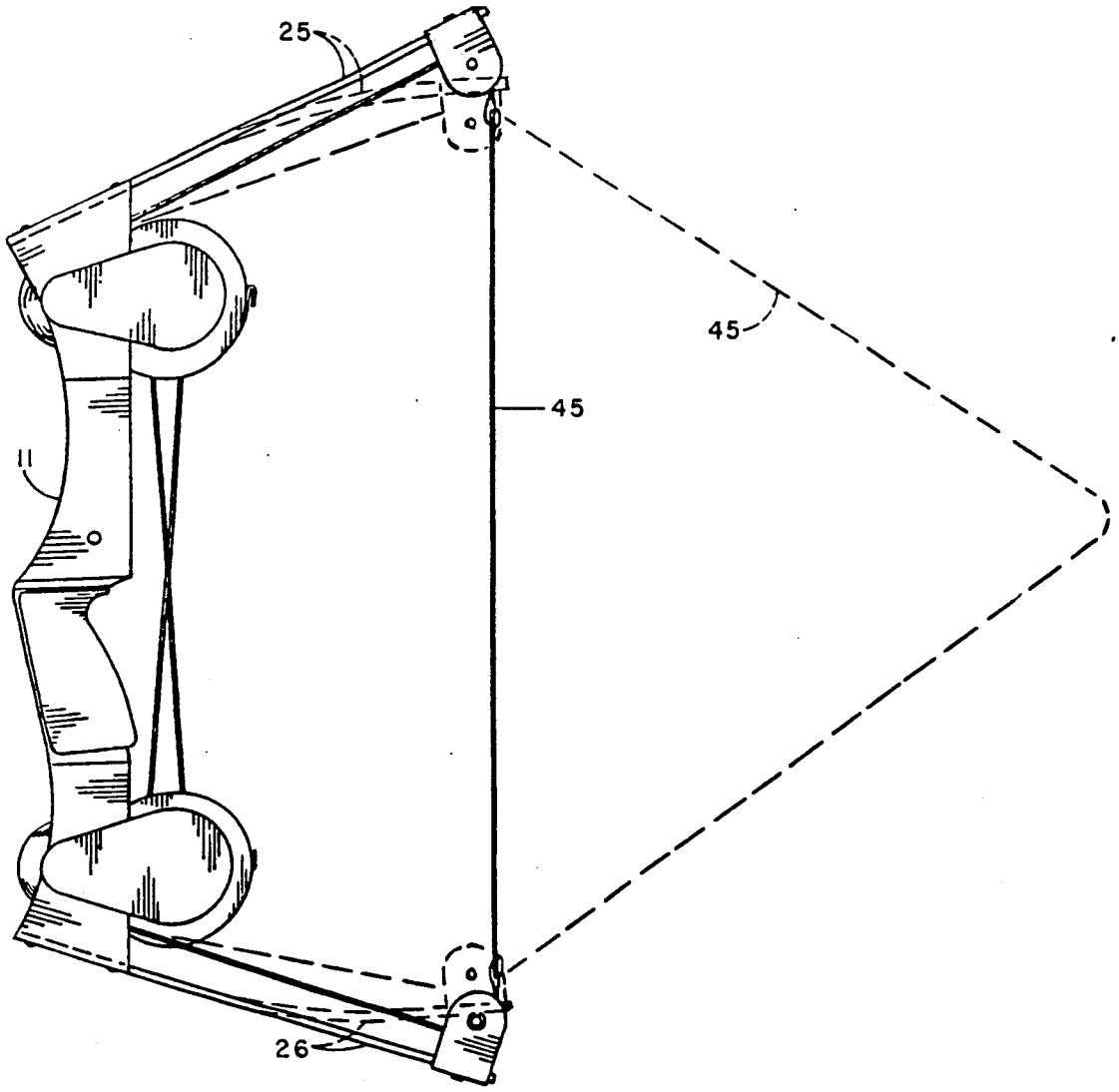
FIG. 11 is a schematic diagram showing the relative positions of the string at rest and at full draw in the bow of FIG. 8.

FIG. 10 schematically depicts the relationship of the riser, limbs and bow string in at-rest and fully drawn positions, respectively.

In a specific example of the invention, the bow has an overall length of only about two feet, as compared with approximately four feet for a conventional compound bow, and has an overall front-to-rear dimension of about one foot. The riser and limbs may be made of any suitable material, including plastics, metal and the like. One suitable material for the limbs, for example, is titanium. Using this material, which has a modulus of elasticity of $16\times10^6$ psi, and designing for a bow having a power rating of 60 pounds, if the diameter of the recoil spools is 0.50 inch, then one full rotation of the recoil spool will result in winding up approximately 1.5 inches of cable. This, in turn, causes approximately 1.5 inches of deflection in the limbs. If the limbs each have an active length of 8.25 inches and a width of 1.5 inches, then the thickness of the limbs would need to be 0.155 inch.

The springs 80 and 81 preferably comprise cold rolled carbon steel strip, ASTM 682, AISI 1074, and have a width of 0.50 inches, a thickness of 0.062 inches and a length of 156 inches. The housing 87 for containing the spring has a diameter of five inches, and the shaft 75 has a diameter of 0.625 inches. The spring is designed to deliver 49 inch-pounds of torque at two and one half revolutions (50% of the total available deflection and 82% of the total available torque). When the spring is installed, it is pre-loaded to 49 inch-pounds (wound to 2.5 revolutions). Thus, when the bow string is drawn back the spring is further wound, but the remaining available torque is only 18% of the total available of approximately 60 inch-pounds, i.e., only about 10.8 inch-pounds. Consequently, at the mid-point of the draw, where the "let-off" becomes effective, the spring has developed approximately 54 inch-pounds of torque. It should be noted that during operation from an at-rest position to a full draw position, the spring only makes one revolution.

The let-off action of the bow of the invention, as achieved through the mechanical advantages gained through the use of larger and smaller diameter drive and driven wheels and shafts, and the use of an eccentric cam or wheel, reduces the force required by one-half. Therefore, at mid-draw, the required force to draw the string drops from approximately 54 inch-pounds to approximately 27 inch-pounds and increases to only about 30 inch-pounds at full draw. The effect is reversed when the string is released, and the dramatic increase in torque at approximately the mid-point is transmitted to the arrow.

Although two spring assemblies are used, each developing the same torque, the effectiveness of each spring is reduced by one-half because of the relationships between the cable spool 50' and the cam drive wheel 73. Thus, to realize 54 inch-pounds of torque at half draw, two spring assemblies each developing that amount of torque are required.

The performance of the springs may be altered by changing the pre-loaded torque. For instance, the springs could be wound only one revolution as installed, instead of two and one-half revolutions. In this case, the springs would be pre-loaded to 30 inch-pounds (50% of the available torque). An additional 15 inch-pounds would be available in the additional one revolution required, and approximately eight of those inch-pounds would be realized at mid-draw. Thus, at mid-draw, the required force to draw the string would drop from 38 inch-pounds to 19 inch-pounds. The recoil performance would be similarly effected.

The frame and arms, pulleys, wheels and housings could be made of any suitable material, including reinforced glass fiber, metal (aluminum, etc.), wood and the like.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

We claim:

1. An archery bow, comprising:

an elongate riser having opposite ends, and means between the ends defining a hand grip;

a flexible limb secured on each end of the riser, each limb secured at one end to a respective end of the riser and extending outwardly therefrom to a free end;

an idler wheel at the free end of each limb;

a single bow string for both propelling and drawing extending between the free ends of the opposing limbs and entrained over the idler wheels; and recoil means connected with opposite ends of the bow string, said recoil means including spring means, a take-up spool mounted on the riser, to which one end of the bow string is attached for winding up a length of said bow string, and a cam connected between the spring means and the take-up spool, said cam being rotatably connected to the take-up spool and functioning as a let-off for reducing the force required to move and hold the bow string at full draw.

2. An archery bow as claimed in claim 1, wherein:
said recoil means comprises two recoil assemblies each having a take-up spool and a cam, with one assembly at each end of the riser, and opposite ends of the bow string being connected to a respective recoil assembly.

3. An archery bow as claimed in claim 2, wherein:
the riser has bifurcated ends defining a pair of spaced apart mounting arms, said recoil assemblies being mounted to said mounting arms.

4. An archery bow as claimed in claim 3, wherein:
the recoil assemblies each include a recoil spool rotatably supported in the bifurcated ends between the mounting arms; and
a recoil cable connects the respective recoil spools with the free ends of the opposite limb.

5. An archery bow as claimed in claim 2, wherein:
opposite ends of the bow string are connected with the take-up spools in the respective recoil assemblies, and the cams are connected to be rotated with the take-up spools.

6. An archery bow as claimed in claim 5, wherein:
each recoil assembly includes a recoil cable connected at one end to a respective cam and connected at its other end to the free end of the opposing limb, whereby movement of the bow string to its drawn position causes the bow string to be unwound from the respective take-up spools, thereby rotating the cams and causing the recoil cable attached thereto to deflect the limb to which it is attached, storing energy, said limbs comprising the spring means.

7. An archery bow as claimed in claim 5, wherein:
said spring means includes flat wound coil spring means mounted to said riser, said coil spring means being connected at one end for rotation with the take-up spool and fixed against movement at its other end, whereby movement of said bow string from an at-rest position to a drawn position causes said spring to wind up, storing energy therein so that release of said bow string results in release of the stored energy in the coil spring to the string to return it to its initial position and thus propel an arrow nocked therein.

8. An archery bow as claimed in claim 7, wherein:
each recoil assembly includes a flat wound coil spring.

9. An archery bow as claimed in claim 8, wherein:
each recoil assembly includes mechanical advantage means connected between the respective end of the bow string and the respective flat wound coil spring, whereby the force required to move the bow string from its at-rest position to its drawn position is less than the poundage rating of the bow.

10. An archery bow as claimed in claim 9, wherein:
there are multiple mechanical advantage means associated with each recoil assembly, including the cam, for reducing the force required to move the string during its movement between its at-rest position and its fully drawn position.

11. An archery bow as claimed in claim 10, wherein:
the mechanical advantage means comprises a series of large and small diameter wheels, shafts and pulleys arranged so that a mechanical advantage is obtained when the string is drawn.

12. An archery bow as claimed in claim 11, wherein:
said cam means is operative to change its force lever arm during movement between the at-rest position of the string and the fully drawn position of the string and thereby effect a reduction in the force necessary to move the string.

13. An archery bow as claimed in claim 9, wherein:
synchronization means is connected between the recoil assemblies at opposite ends of the riser for synchronizing the action of the recoil assemblies.

14. An archery bow as claimed in claim 13, wherein:
the synchronization means comprise a synchronizing wheel connected to rotate with each of said cams, and a synchronizing cable extending around the synchronizing wheels at opposite ends of the riser.

15. An archery bow as claimed in claim 2, wherein:
said limbs comprise the spring means; and
said bow string is connected at opposite ends thereof with a take-up spool in each of the recoil assemblies, said take-up spools being connected with said cams to effect rotation of the cams when the take-up spool is rotated by drawing the bow string, and a recoil cable is connected at its opposite ends between the cams and the free ends of the opposing limbs to cause deflection of the limbs when the bow string is drawn, thus storing energy.

* * * * *